US010208907B2

(12) United States Patent
Wang et al.

(10) Patent No.: US 10,208,907 B2
(45) Date of Patent: Feb. 19, 2019

(54) LIGHTING DEVICE AND REFLECTIVE PLATE THEREFOR FOR MAKING THE LIGHTING DEVICE GENERATE A PREDETERMINED LIGHT TYPE

(71) Applicants: LITE-ON ELECTRONICS (GUANGZHOU) LIMITED, Guangzhou (CN); LITE-ON TECHNOLOGY CORPORATION, Taipei (TW)

(72) Inventors: Shih-Chang Wang, Taipei (TW); Wei-Wen Shih, Taipei (TW); Pin-Hao Hsu, Taipei (TW)

(73) Assignees: LITE-ON ELECTRONICS (GUANGZHOU) LIMITED, Guangzhou (CN); LITE-ON TECHNOLOGY CORPORATION, Taipei (TW)

( * ) Notice: Subject to any disclaimer, the term of this patent is extended or adjusted under 35 U.S.C. 154(b) by 107 days.

(21) Appl. No.: 15/456,737

(22) Filed: Mar. 13, 2017

(65) Prior Publication Data

US 2018/0187845 A1 Jul. 5, 2018

(30) Foreign Application Priority Data

Jan. 5, 2017 (CN) ..... 2017 1 0007074

(51) Int. Cl.
*F21S 8/08* (2006.01)
*F21V 17/06* (2006.01)
(Continued)

(52) U.S. Cl.
CPC ..... *F21S 8/085* (2013.01); *F21V 7/0025* (2013.01); *F21V 13/04* (2013.01); *F21V 3/049* (2013.01);
(Continued)

(58) Field of Classification Search
CPC . F21S 8/085; F21S 8/086; F21S 8/088; F21V 17/06; F21V 14/04; F21V 13/04; F21V 13/06; F21W 2111/02
See application file for complete search history.

(56) References Cited

U.S. PATENT DOCUMENTS 6,982,518 B2 1/2006 Chou et al.
7,226,189 B2 6/2007 Lee et al.
(Continued)

OTHER PUBLICATIONS

TIPO Office Action dated Aug. 9, 2017 in Taiwan application (No. 106100301).

*Primary Examiner* — Alan B Cariaso
(74) *Attorney, Agent, or Firm* — McClure, Qualey & Rodack, LLP

(57) ABSTRACT

A lighting device including an upper casing, a light emitting diode (LED) light source, a first reflective plate and a packaging lens is disclosed. The upper casing includes a supporting member. The LED light source is disposed on the supporting member. The first reflective plate is disposed on the supporting member and is separated from the LED light source by a first distance. The first reflective plate and a normal line of a supporting surface of the supporting member form a first angle which is greater than 0° and smaller than 40°. The packaging lens is disposed on the supporting member and covers the LED light source and the first reflective plate.

10 Claims, 7 Drawing Sheets

(51) Int. Cl.

| | |
|---|---|
| ***F21V 13/04*** | (2006.01) |
| ***F21V 7/00*** | (2006.01) |
| *F21Y 115/10* | (2016.01) |
| *F21V 3/04* | (2018.01) |
| *F21V 5/04* | (2006.01) |
| *F21V 14/04* | (2006.01) |
| *F21W 131/103* | (2006.01) |

(52) U.S. Cl.
CPC ..... *F21V 5/045* (2013.01); *F21V 14/04* (2013.01); *F21W 2131/103* (2013.01); *F21Y 2115/10* (2016.08)

(56) References Cited

U.S. PATENT DOCUMENTS

| | | | | |
|---|---|---|---|---|
| 8,322,881 | B1 * | 12/2012 | Wassel | F21V 7/00 362/247 |
| 2009/0103288 | A1 * | 4/2009 | Boyer | F21V 7/04 362/153.1 |
| 2009/0257225 | A1 * | 10/2009 | Sun | F21S 8/086 362/247 |
| 2012/0098404 | A1 * | 4/2012 | Kaandorp | F21V 14/04 313/114 |
| 2013/0010470 | A1 * | 1/2013 | Min | F21V 7/0025 362/238 |

* cited by examiner

LIGHTING DEVICE AND REFLECTIVE PLATE THEREFOR FOR MAKING THE LIGHTING DEVICE GENERATE A PREDETERMINED LIGHT TYPE

This application claims the benefit of People's Republic of China application Serial No. 201710007074.1, filed Jan. 5, 2017, and the subject matter of which is incorporated herein by reference.

BACKGROUND OF THE INVENTION

Field of the Invention

The invention relates in general to a lighting device, and more particularly to a lighting device used in road lighting.

Description of the Related Art

Street lights provide different light types in response to street conditions. Conventional street lights are normally equipped with multiple light sources respectively combined with secondary optics. For example, a street light is equipped with three lighting modules having different light types. However, the design of installing multiple lighting modules in a street light incurs higher manufacturing cost and occupies a larger space. Therefore, it has become a prominent task for the industry to provide a new technology capable of resolving the above problems.

SUMMARY OF THE INVENTION

The invention is directed to a lighting device capable of resolving the abovementioned problems existing in current technologies.

According to one embodiment of the present invention, a lighting device is disclosed. The lighting device includes an upper casing, a light emitting diode (LED) light source, a first reflective plate and a packaging lens is disclosed. The upper casing includes a supporting member. The LED light source is disposed on the supporting member. The first reflective plate is disposed on the supporting member and is separated from the LED light source by a first distance. The first reflective plate and a normal line of a supporting surface of the supporting member form a first angle which is greater than 0° and smaller than 40°. The packaging lens is disposed on the supporting member and covers the LED light source and the first reflective plate.

Wherein, the first angle is 10°-30°.

Wherein, the first reflective plate is separated from an inner curved surface of the packaging lens by 1-20 mm.

Wherein, a top edge of the first reflective plate is conformal with an inner curved surface of the packaging lens and is separated from the inner curved surface of the packaging lens by 1-3 mm.

Wherein, a ratio of the first distance to a height of the first reflective plate is 0.16-0.5.

Wherein, the lighting device further includes a second reflective plate disposed on the supporting member and separated from the LED light source by a second distance; the second reflective plate and the normal line of the supporting surface of the supporting member form a second angle which is greater than 0° and smaller than 40°.

Wherein, the LED light source is disposed between the first reflective plate and the second reflective plate.

Wherein, one of the first reflective plate and the second reflective plate is disposed on the side of the LED light source closer to the road; the other one of the first reflective plate and the second reflective plate is disposed on the side of the LED light source farther away from the road.

Wherein, a top edge of the second reflective plate is conformal with an inner curved surface of the packaging lens and is separated from the inner curved surface of the packaging lens by 1-3 mm.

Wherein, a ratio of the second distance to a height of the second reflective plate is 0.375-0.5.

Wherein, the packaging lens has an inner curved surface; a ratio of a distance between the inner curved surface and the supporting surface of the supporting member to a thickness of the packaging lens is 9-20.

Wherein, the upper casing further includes at least two linking members disposed on the supporting member; the first reflective plate is connected to the supporting member by any one of the two linking members, and the two linking members have different extending directions.

Wherein, the upper casing further includes at least one rotation mechanism disposed on the supporting member; the first reflective plate is rotatably connected to the supporting member through the rotation mechanism, and the first angle is adjustable through the rotation mechanism.

The above and other aspects of the invention will become better understood with regard to the following detailed description of the preferred but non-limiting embodiment(s). The following description is made with reference to the accompanying drawings.

DETAILED DESCRIPTION OF THE INVENTION

A number of embodiments of the present disclosure are disclosed below with reference to accompanying drawings. Designations common to the accompanying drawings and embodiments are used to indicate identical or similar elements. It should be noted that the accompanying drawings are already simplified to more clearly illustrate the embodiment of the present disclosure, the structure and description of the implementations of the present disclosure are for exemplary purpose only, not for limiting the scope of protection of the present disclosure. Anyone ordinary skilled in the technology field can make necessary modifications or adjustments based on the needs of actual implementations.

Figure 1:
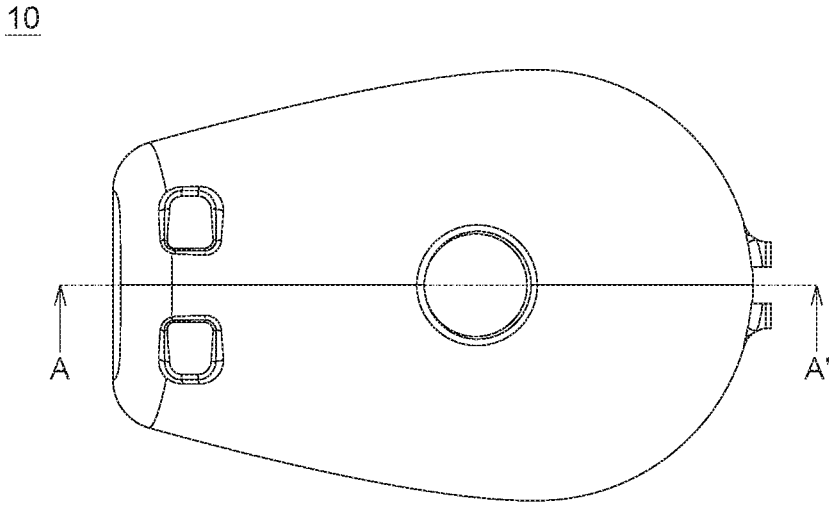
FIG. 1 is a top view of a lighting device according to an embodiment of the disclosure.
Figure 2:
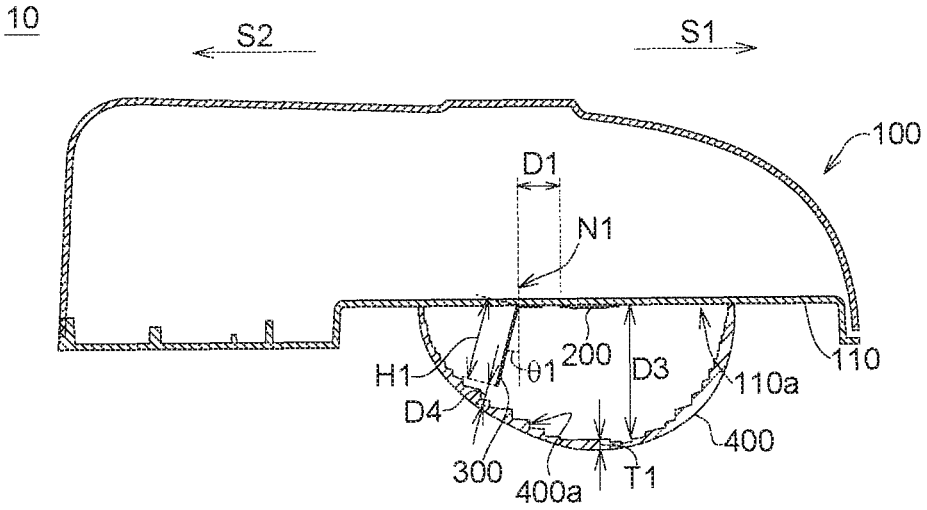
FIG. 2 is a cross-sectional view along the cross-sectional line A-A' of FIG. 1.

Refer to FIG. 1 and FIG. 2. FIG. 1 is a top view of a lighting device according to an embodiment of the disclosure. FIG. 2 is a cross-sectional view along the cross-sectional line A-A' of FIG. 1. The lighting device 10 is such as a street light.

As indicated in FIGS. 1-2, the lighting device 10 includes an upper casing 100, a light emitting diode (LED) light source 200, a first reflective plate 300 and a packaging lens 400. The upper casing 100 includes a supporting member 110. The LED light source 200 and the first reflective plate 300 are disposed on the supporting member 110. The first reflective plate 300 is separated from the LED light source 200 by a first distance D1. The first reflective plate 300 and a normal line N1 of a supporting surface 110*a* of the supporting member 110 form a first angle θ1 which is greater than 0° and smaller than 40°. The packaging lens 400 is disposed on the supporting member 110 and covers the LED light source 200 and the first reflective plate 300.

In some embodiments, the first angle θ1 is 10°-30°.

The first reflective plate 300 arranged at a suitable first angle θ1 can effectively guide the light emitted by the LED light source 200 towards a predetermined direction and make the lighting device 10 generate a predetermined light type.

As indicated in FIG. 2, a ratio (D1/H1) of the first distance D1 to a height H1 of the first reflective plate 300 is 0.16-0.5. In some embodiments, the first distance D1 is 8-15 millimeters (mm). When the first distance D1 or the ratio (D1/H1) of the first distance D1 to the height H1 is too large, the light emitted by the LED light source 200 needs to travel through a longer optical path to be reflected by the first reflective plate 300. Under such circumstances, it is hard to generate the predetermined light type.

In some embodiments, the ratio of the height of the outer curved surface (the distance between the outer curved surface 400*b* and the supporting surface 110*a*) to the first distance D1 and further to the height H1 of the first reflective plate 300 is approximately 52:15:47.

As indicated in FIG. 2, the packaging lens 400 has an inner curved surface 400*a*, and a ratio (D3/T1) of a distance D3 between the inner curved surface 400*a* and the supporting surface 110*a* of the supporting member 110 to a thickness T1 of the packaging lens 400 is 9-20. In other words, the thickness T1 of the packaging lens 400 is relatively small. Given that the space condition is fixed, the disposition of the packaging lens 400 having a smaller thickness allows the first reflective plate 300 to have a larger dimension, and therefore increases the light reflecting area of the first reflective plate 300, not only producing the predetermined light type but further enhancing the light intensity and reducing the overall volume of the lighting device 10.

In some embodiments, the distance D4 between the first reflective plate 300 and an inner curved surface 400*a* of the packaging lens 400 is 1-20 mm.

In some embodiments, the first reflective plate 300 can be disposed on the side S1 of the LED light source 200 closer to the road or disposed on the side S2 of the LED light source 200 farther away from the road. As indicated in FIG. 2, the first reflective plate 300 is disposed on the side S2 of the LED light source 200 farther away from the road, that is, the side closer to the house.

In some embodiments, the upper casing 100 can selectively include at least two linking members (not illustrated) disposed on the supporting member 110. The first reflective plate 300 can be connected to the supporting member 110 through any one of the two linking members. The two linking members have different extending directions, such that the first reflective plate 300 connected to the linking member has a corresponding extending direction. In other words, when the first reflective plate 300 is connected to different linking members having different extending directions, the first angle θ1 of the first reflective plate 300 will be different. For example, the linking member can be realized by many slots having different extending directions, and the first reflective plate 300 inserted into different slots will have different first angles θ1.

In some embodiments, the upper casing 100 can selectively include at least one rotation mechanism (not illustrated) disposed on the supporting member 110, and the first reflective plate 300 can be rotatably connected to the supporting member 110 through the rotation mechanism, and the first angle θ1 can further be adjusted through the rotation mechanism.

Figure 3:
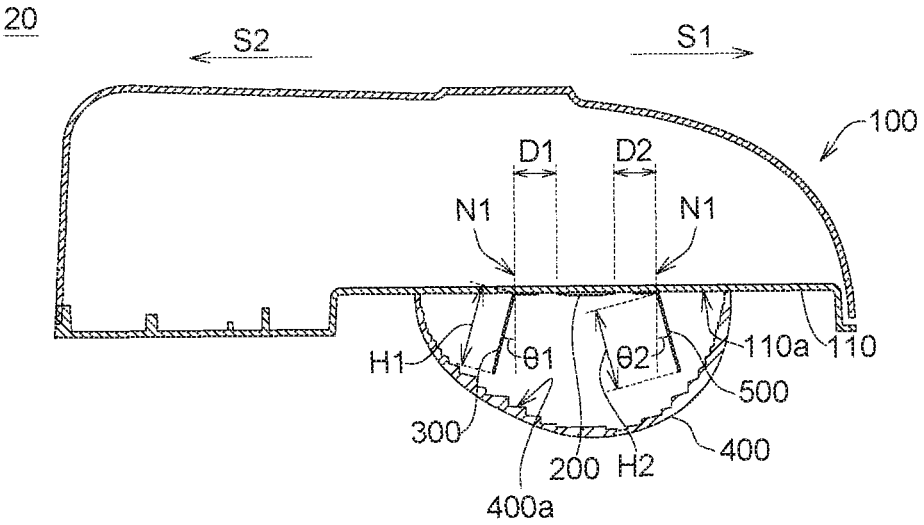
FIG. 3 is a cross-sectional view along the cross-sectional line A-A of FIG. 1 according to another embodiment.

FIG. 3 is a cross-sectional view along the cross-sectional line A-A' of FIG. 1 according to another embodiment. Designations common to the present and above embodiments are used to indicate identical or similar elements, and relevant descriptions of identical or similar elements are disclosed above and the similarities are not repeated here.

As indicated in FIG. 3, the lighting device 20 further includes a second reflective plate 500. The LED light source 200 is disposed between the first reflective plate 300 and the second reflective plate 500. The second reflective plate 500 is disposed on the supporting member 110 and is separated from the LED light source 200 by a second distance D2. The second reflective plate 500 and the normal line N1 of the supporting surface 110*a* of the supporting member 110 form a second angle θ2 which is greater than 0° and smaller than 40°. In some embodiments, the second angle θ2 is 20°-30°.

In some embodiments, a ratio (D2/H2) of the second distance D2 to a height H2 of the second reflective plate 500 is 0.375-0.5. In some embodiments, the second distance D2 is approximately equivalent to 15 mm.

In some embodiments, one of the first reflective plate 300 and the second reflective plate 500 is disposed on the side S1 of the LED light source 200 closer to the road, and the other one of the first reflective plate 300 and the second reflective plate 500 is disposed on the side S2 of the LED light source 200 farther away from the road. As indicated in FIG. 3, the second reflective plate 500 is disposed on the side S1 of the LED light source 200 closer to the road, and the first reflective plate 300 is disposed on the side S2 of the LED light source 200 farther away from the road (that is, the side closer to the house).

Figure 4A:
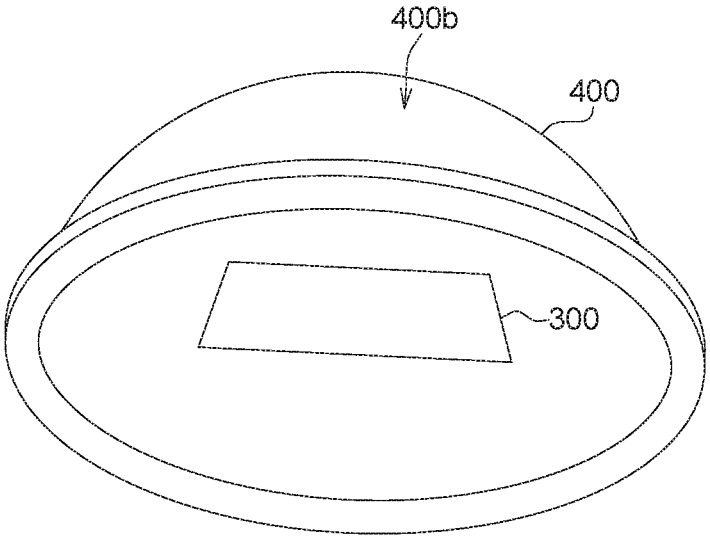
FIG. 4A is a partial 3D perspective view of a lighting device according to an embodiment of the disclosure.
Figure 4B:
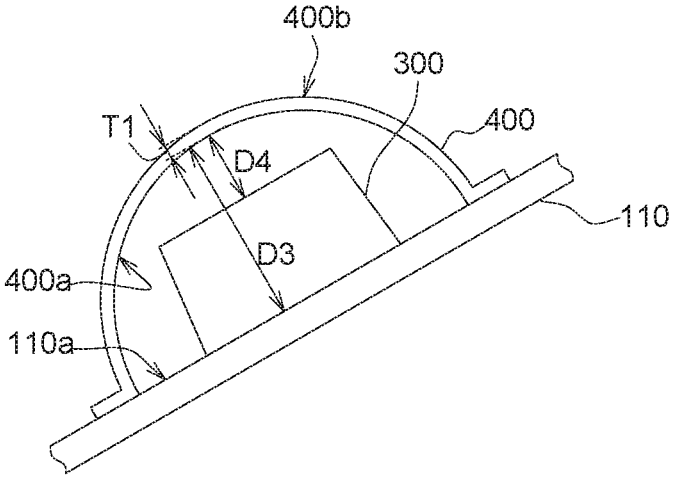
FIG. 4B is a cross-sectional view along the first reflective plate of FIG. 4A.

FIG. 4A is a partial 3D perspective view of a lighting device according to an embodiment of the disclosure. FIG. 4B is a cross-sectional view along the first reflective plate of FIG. 4A. Designations common to the present and above embodiments are used to indicate identical or similar elements, and relevant descriptions of identical or similar elements are disclosed above and the similarities are not repeated here. It should be noted that some elements are omitted in the diagrams so that technical features of some elements can be more clearly illustrated.

In the present embodiment as indicated in FIGS. 4A-4B, the first reflective plate 300 is realized by a rectangular reflective plate, and the distance D4 between the top of the first reflective plate 300 and the inner curved surface 400*a* of the packaging lens 400 is 1-20 mm.

Similarly, the lighting device of the present embodiment further includes the said second reflective plate 500 (not illustrated in FIGS. 4A-4B), which can be realized by a rectangular reflective plate.

Figure 5A:
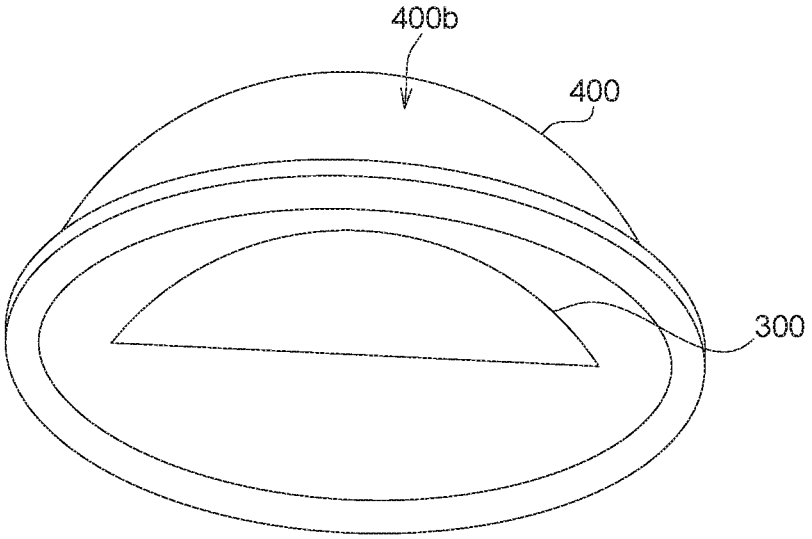
FIG. 5A is a partial 3D perspective view of a lighting device according to another embodiment of the disclosure.
Figure 5B:
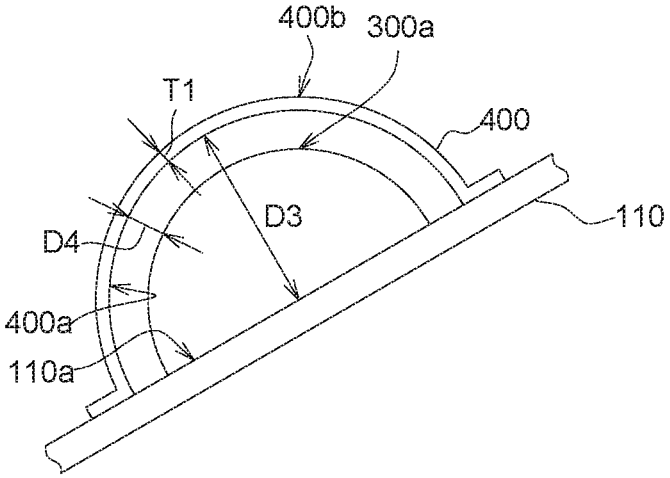
FIG. 5B is a cross-sectional view along the first reflective plate of FIG. 5A.

FIG. 5A is a partial 3D perspective view of a lighting device according to another embodiment of the disclosure. FIG. 5B is a cross-sectional view along the first reflective plate of FIG. 5A. Designations common to the present and above embodiments are used to indicate identical or similar elements, and relevant descriptions of identical or similar elements are disclosed above and the similarities are not repeated here. It should be noted that some elements are omitted in the diagrams so that technical features of some elements can be more clearly illustrated.

As indicated in FIGS. 5A-5B, a top edge 300*a* of the first reflective plate 300 is conformal with the inner curved surface 400*a* of the packaging lens 400, and the distance D4 between the top edge 300*a* of the first reflective plate 300 and the inner curved surface 400*a* of the packaging lens 400 is 1-3 mm.

As indicated in FIGS. 5A-5B, the first reflective plate 300 can be realized by a semicircular reflective plate and the cross-section of the inner curved surface 400*a* of the packaging lens 400 also has a semicircular shape such that the top edge 300*a* of the first reflective plate 300 is conformal with the inner curved surface 400*a* of the packaging lens 400 and the distance D4 (1-3 mm) between the first reflective plate 300 and the inner curved surface 400*a* of the packaging lens 400 is substantially identical along the semicircular top edge 300*a*. Since the distance D4 can be reduced under the conformal design, the first reflective plate 300 can achieve better light guiding effect and enable the lighting device to generate the predetermined light type.

Similarly, the lighting device of the present embodiment further includes the said second reflective plate 500 (not illustrated in FIGS. 5A-5B), a top edge of the second reflective plate 500 is conformal with the inner curved surface 400*a* of the packaging lens 400, and the distance between the top edge of the second reflective plate 500 and the inner curved surface 400*a* of the packaging lens 400 is 1-3 mm.

Figure 6A:
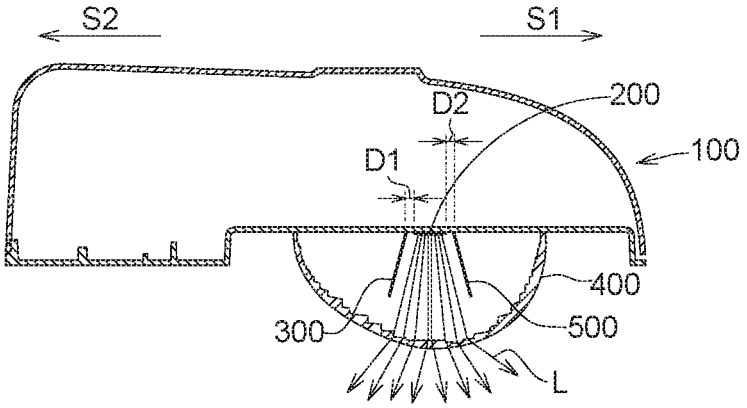
FIG. 6A is an optical path simulation chart of a lighting device according to an embodiment of the disclosure.
Figure 6B:
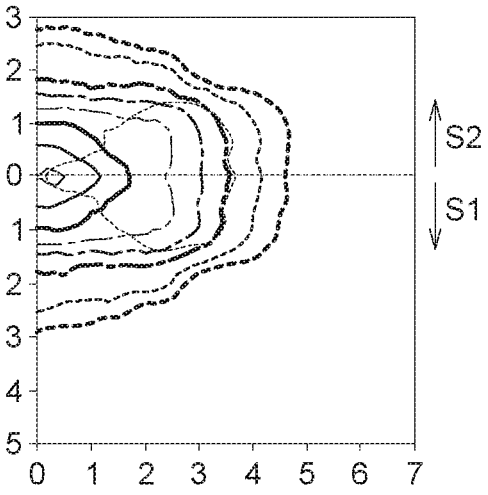
FIG. 6B is a light pattern chart of the lighting device of FIG. 6A.
Figure 7A:
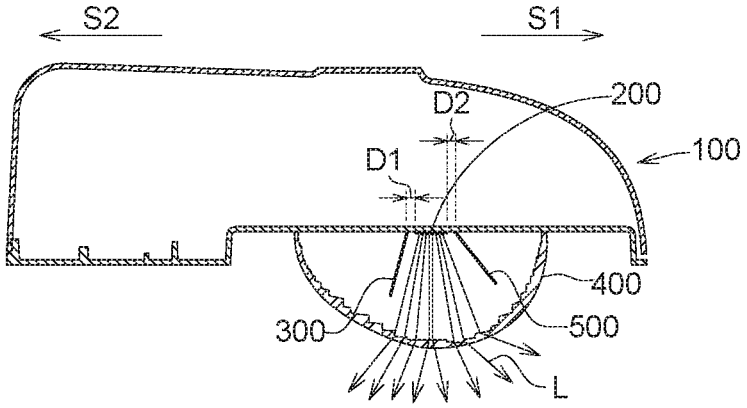
FIG. 7A is an optical path simulation chart of a lighting device according to an embodiment of the disclosure.
Figure 7B:
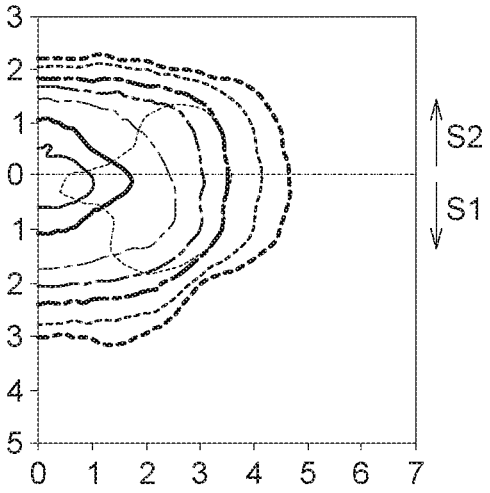
FIG. 7B is a light pattern chart of the lighting device of FIG. 7A.
Figure 8A:
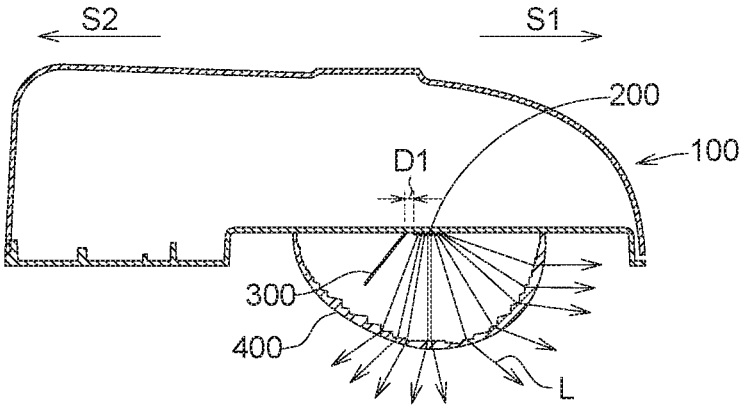
FIG. 8A is an optical path simulation chart of a lighting device according to an embodiment of the disclosure.
Figure 8B:
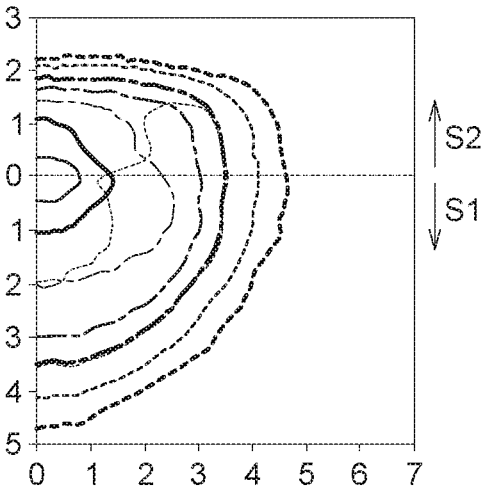
FIG. 8B is a light pattern chart of the lighting device of FIG. 8A.

FIG. 6A is an optical path simulation chart of a lighting device according to an embodiment of the disclosure. FIG. 6B is a light pattern chart of the lighting device of FIG. 6A. FIG. 7A is an optical path simulation chart of a lighting device according to an embodiment of the disclosure. FIG. 7B is a light pattern chart of the lighting device of FIG. 7A. FIG. 8A is an optical path simulation chart of a lighting device according to an embodiment of the disclosure. FIG. 8B is a light pattern chart of the lighting device of FIG. 8A. Designations common to the present and above embodiments are used to indicate identical or similar elements, and relevant descriptions of identical or similar elements are disclosed above and the similarities are not repeated here. The embodiments disclosed below are for explanatory and exemplary purposes only, not for limiting the scope of protection of the invention.

Table 1 illustrates the design conditions of the reflective plate, the light types and the distribution of light intensities for the lighting device of each embodiment indicated in FIGS. 6A, 7A and 8A. Embodiment 1-1, embodiment 1-2 and embodiment 1-3 are respectively indicated in FIG. 6A, FIG. 7A, and FIG. 8A. For each packaging lens 400 used in the embodiments, the inner curved surface (the distance D3 between the inner curved surface 400*a* and the supporting surface 110*a*) has a height of 48.5 mm, the outer curved surface (the distance between the outer curved surface 400*b* and the supporting surface 110*a*) has a height of 52 mm, and both of the first reflective plate 300 and the second reflective plate 500 can be realized by a rectangular reflective plate.

In Table 1, "θ1" denotes the first angle θ1 of the first reflective plate 300; "H1" denotes the height H1 of the first reflective plate 300, "D1" denotes the first distance D1 between the first reflective plate 300 and the LED light source 200; "θ2" denotes the second angle θ2 of the second reflective plate 500; "H2" denotes the height H2 of the second reflective plate 500; "D2" denotes the second distance D2 between the second reflective plate 500 and the LED light source 200; "Light type" denotes light type; "Road" denotes the light intensity ratio of the side S1 closer to the road; "House" denotes the light intensity ratio of the side S2 farther away from the road (the side closer to house). In an embodiment, the first reflective plate 300 is disposed on the side S1 closer to the road, and the second reflective plate 500 is disposed on the side S2 farther away from the road (the side closer to house).

TABLE 1

| | θ1 (°) | H1 (mm) | D1 (mm) | θ2 (° C.) | H2 (mm) | D2 (mm) | Light type | House (%) | Road (%) |
|---|---|---|---|---|---|---|---|---|---|
| Embodiment 1-1 | 15 | 40 | 15 | 15 | 40 | 15 | Type II | 50 | 50 |
| Embodiment 1-2 | 15 | 30 | 15 | 30 | 30 | 15 | Type III | 39.2 | 60.8 |
| Embodiment 1-3 | 15 | 30 | 15 | NA | NA | NA | Type IV | 35.1 | 64.9 |

Refer to FIGS. 6A-6B, FIGS. 7A-7B and FIGS. 8A-8B. Through the design of different quantities, dimensions and angles of the reflective plate, the light L can be guided to the predetermined direction, such that the lighting device can generate the predetermined light type.

The design conditions of the reflective plate, the light types and the distribution of light intensities for the lighting device of each embodiment are illustrated to describe the characteristics of the lighting device of the disclosure. However, the embodiments disclosed below are for explanatory and exemplary purposes only, not for limiting the scope of protection of the invention.

For each packaging lens 400 used in the following embodiments, the inner curved surface (the distance D3 between the inner curved surface 400*a* and the supporting surface 110*a*) has a height of 48.5 mm, the outer curved surface (the distance between the outer curved surface 400*b* and the supporting surface 110*a*) has a height of 52 mm, the inner curved surface has a maximum width of 169 mm (the inner diameter of packaging lens 400), and both of the first reflective plate 300 and the second reflective plate 500 can be realized by a semicircular reflective plate (refer to FIG. 5B) having a maximum height of 47 mm (equivalent to the first the height H1 or the second height H2 of the reflective plate of Table 1) and a bottom edge of 82 mm.

In Table 2, "θ1" denotes the first angle θ1 of the first reflective plate 300; "H1" denotes the height H1 of the first reflective plate 300; "D1" denotes the first distance D1 between the first reflective plate 300 and the LED light source 200; "θ2" denotes the second angle θ2 of the second reflective plate 500; "Light type" denotes light types; "Light type vertical category" denotes vertical category of the light type; "Road" denotes the light intensity ratio of the side S1 closer to the road; "House" denotes the light intensity ratio of the side S2 farther away from the road (the side closer to house). In an embodiment, the first reflective plate 300 is disposed on the side S1 closer to the road; the second reflective plate 500 is disposed on the side S2 farther away from the road (the side closer to house); both of the first distance D1 between the first reflective plate 300 and the LED light source 200 and the second distance D2 between the second reflective plate 500 and the LED light source 200 are equivalent to 15 mm; all the height of the outer curved surface (the distance between the outer curved surface 400*b* and the supporting surface 110*a*) is equivalent to 52 mm.

TABLE 2

| | θ1 (°) | θ2 (°) | Light type | Light type vertical category | House (%) | Road (%) | H1 (mm) | D1 (mm) |
|---|---|---|---|---|---|---|---|---|
| Embodiment 2-1 | 10 | NA | Type IV | Medium | 28 | 72 | 47-50 | 8-15 |
| Embodiment 2-2 | 15 | NA | Type IV | Medium | 34 | 66 | 47-50 | 8-15 |
| Embodiment 2-3 | 20 | NA | Type IV | Short | 39 | 61 | 47-50 | 8-15 |
| Embodiment 2-4 | 25 | NA | Type IV | Medium | 43 | 57 | 47-50 | 8-15 |
| Embodiment 2.5 | 30 | NA | Type IV | Medium | 46 | 54 | 47-50 | 8-15 |
| Embodiment 3-1 | 5 | 30 | Type III | Medium | 29 | 71 | 47-49 | 12-15 |
| Embodiment 3-2 | 10 | 30 | Type III | Medium | 33 | 67 | 47-49 | 12-15 |
| Embodiment 3-3 | 15 | 30 | Type III | Short | 38 | 62 | 47-49 | 12-15 |
| Embodiment 3-4 | 20 | 30 | Type III | Short | 43 | 57 | 47-49 | 12-15 |
| Embodiment 3-5 | 30 | 30 | Type III | Short | 50 | 50 | 47-49 | 12-15 |
| Embodiment 3-6 | 5 | 25 | Type III | Medium | 33 | 67 | 47-49 | 12-15 |
| Embodiment 3-7 | 10 | 25 | Type III | Medium | 37 | 63 | 47-49 | 12-15 |
| Embodiment 3-8 | 5 | 20 | Type III | Medium | 38 | 62 | 47-49 | 12-15 |
| Embodiment 3-9 | 10 | 20 | Type III | Medium | 41 | 59 | 47-49 | 12-15 |

According to the results illustrated in Table 2, in some embodiments of the disclosure, the ratio between the first distance D1 and the height H1 of the first reflective plate 300 is approximately 8-15:47-50.

Besides, Table 3 also illustrates the light types that can be generated under different combinations of the first angle θ1 of the first reflective plate 300 and the second angle θ2 of the second reflective plate 500.

TABLE 3

| | | The first angle θ1 of the first reflective plate 300 (°) | | | | | | |
|---|---|---|---|---|---|---|---|---|
| | | 0 | 5 | 10 | 15 | 20 | 25 | 30 |
| The second angle θ2(°) of the second reflective plate 500 | 0 | Type IV | | | | | | |
| | 4 | Type IV | Type III | | | | | |
| | 10 | Type IV | Type II | Type II | | | | |
| | 15 | Type IV | Type II | Type II | Type II | | | |
| | 20 | Type IV | Type III | Type III | Type II | Type II | | |
| | 25 | Type IV | Type III | Type III | Type II | Type II | Type II | |
| | 30 | Type IV | Type III | Type III | Type III | Type III | Type II | Type III |

According to the embodiments of the disclosure, with the disposition of the first reflective plate 300 and/or the second reflective plate 500 arranged at a corresponding angle, a particular light type of the lighting device can be easily generated without installing multiple light sources having different light types or combining multiple light sources with multiple sets of secondary optics.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A lighting device, comprising:

an upper casing comprising a supporting member;

a light emitting diode (LED) light source disposed on the supporting member;

a first reflective plate disposed on the supporting member and separated from the LED light source by a first distance, wherein the first reflective plate and a normal line of a supporting surface of the supporting member form a first angle which is greater than 0° and smaller than 40°; and a packaging lens disposed on the supporting member and covering the LED light source and the first reflective plate, wherein the first reflective plate is separated from an inner curved surface of the packaging lens by 1-20 mm.

2. The lighting device according to claim 1, wherein the first angle is 10°-30°.

3. The lighting device according to claim 1, wherein a ratio of the first distance to a height of the first reflective plate is 0.16-0.5.

4. The lighting device according to claim 1, further comprising a second reflective plate disposed on the supporting member and separated from the LED light source by a second distance, wherein the second reflective plate and the normal line of the supporting surface of the supporting member form a second angle which is greater than 0° and smaller than 40°.

5. The lighting device according to claim 4, wherein the LED light source is disposed between the first reflective plate and the second reflective plate.

6. The lighting device according to claim 4, wherein one of the first reflective plate and the second reflective plate is disposed on the side of the LED light source closer to the road, and the other one of the first reflective plate and the second reflective plate is disposed on the side of the LED light source farther away from the road.

7. The lighting device according to claim 4, wherein a ratio of the second distance to a height of the second reflective plate is 0.375-0.5.

8. A lighting device, comprising:

an upper casing comprising a supporting member;

a light emitting diode (LED) light source disposed on the supporting member;

a first reflective plate disposed on the supporting member and separated from the LED light source by a first distance, wherein the first reflective plate and a normal line of a supporting surface of the supporting member form a first angle which is greater than 0° and smaller than 40°, and a packaging lens disposed on the supporting member and covering the LED light source and the first reflective plate, wherein a top edge of the first reflective plate is conformal with an inner curved surface of the packaging lens and is separated from the inner curved surface of the packaging lens by 1-3 mm.

9. A lighting device, comprising:

an upper casing comprising a supporting member;

a light emitting diode (LED) light source disposed on the supporting member;

a first reflective plate disposed on the supporting member and separated from the LED light source by a first distance, wherein the first reflective plate and a normal line of a supporting surface of the supporting member form a first angle which is greater than 0° and smaller than 40°;

a packaging lens disposed on the supporting member and covering the LED light source and the first reflective plate; and a second reflective plate disposed on the supporting member and separated from the LED light source by a second distance, wherein the second reflective plate and the normal line of the supporting surface of the supporting member form a second angle which is greater than 0° and smaller than 40°, wherein a top edge of the second reflective plate is conformal with an inner curved surface of the packaging lens and is separated from the inner curved surface of the packaging lens by 1-3 mm.

10. A lighting device, comprising:

an upper casing comprising a supporting member;

a light emitting diode (LED) light source disposed on the supporting member;

a first reflective plate disposed on the supporting member and separated from the LED light source by a first distance, wherein the first reflective plate and a normal line of a supporting surface of the supporting member form a first angle which is greater than 0° and smaller than 40°; and a packaging lens disposed on the supporting member and covering the LED light source and the first reflective plate, wherein the packaging lens has an inner curved surface and a ratio of a distance between the inner curved surface and the supporting surface of the supporting member to a thickness of the packaging lens is 9-20.

* * * * *